US005913641A

United States Patent [19]

Long

[11] Patent Number: 5,913,641

[45] Date of Patent: Jun. 22, 1999

[54] TENSIONABLE CABLE TRUSS SUPPORT SYSTEM

[75] Inventor: Lawrence E. Long, Avon Lake, Ohio

[73] Assignee: Dyckeroff & Widmann AG of Munich, Munich, Germany

[21] Appl. No.: 08/994,940

[22] Filed: Dec. 19, 1997

[51] Int. Cl.[6] ..... E21D 21/00

[52] U.S. Cl. ..... 405/302.2; 405/288

[58] Field of Search ..... 405/302.1, 302.2, 405/302.3, 288

[56] References Cited

U.S. PATENT DOCUMENTS

| | | | |
|---|---|---|---|
| 3,427,811 | 2/1969 | White | 61/45 |
| 3,505,824 | 4/1970 | White | 405/302.2 |
| 3,509,726 | 5/1970 | White | 61/45 |
| 3,601,994 | 8/1971 | Galis | 61/45 R |
| 4,265,571 | 5/1981 | Scott | 405/459 |
| 4,349,300 | 9/1982 | Kelley | 405/288 |
| 4,601,616 | 7/1986 | Barish et al. | 405/288 |
| 4,630,974 | 12/1986 | Sherman | 405/288 |
| 4,634,318 | 1/1987 | Koumal | 405/302.2 |
| 4,749,310 | 6/1988 | White | 405/288 |
| 5,193,940 | 3/1993 | Long | 405/259.1 |
| 5,238,329 | 8/1993 | Long et al. | 405/288 |
| 5,302,056 | 4/1994 | Calandra, Jr. et al. | 405/288 |
| 5,378,087 | 1/1995 | Locotos | 405/259.5 |
| 5,425,602 | 6/1995 | Seegmiller | 405/302.2 |
| 5,462,391 | 10/1995 | Castle et al. | 405/302.2 |
| 5,466,095 | 11/1995 | Scott | 405/302.2 |
| 5,584,608 | 12/1996 | Gillespie | 405/259.6 |
| 5,624,212 | 4/1997 | Gillespie | 405/302.2 |

OTHER PUBLICATIONS

Oldsen et al. "Continuing Development of Innovative Cable Support Systems," 16$^{th}$ Conference on Ground Control in Mining, pp. 117–128 (Aug. 1997).

Tadolini et al. "Recent Developments in Cable Support Technology," Society for Mining, Metallurgy, and Exploration, Inc., Preprint 98–26, pp. 1–6 (Mar. 1998).

Mangelsdorf, "Strain Energy as a Basis for Optimizing Roof Truss Installations in bedded Roof," Report of Investigations 9182, Bureau of Mines Report of Investigations/1988, United States Dept. of the Interior (pp. 1–24).

J.M. Goris, "Laboratory Evaluation of Cable Bolt Supports (In Two Parts), 1: Evaluation of Supports Using Conventional Cables," Report of Investigations 9308, Bureau of Mines Report of Investigations/1990, United States Dept. of the Interior (pp. 1–23).

J.M. Goris, "Laboratory Evaluation of Cable Bolt Supports (In Two Parts), 2: Evaluation of Supports Using Conventional Cables with Steel Buttons, Birdcage Cables, and Epoxy–Coated Cables" Report of Investigations 9308, Bureau of Mines Report of Investigations/1990, United States Dept. of the Interior (pp. 1–23).

Jennmar/Scott Cable Systems Instruction Manual (1995).

*Primary Examiner*—Tamara Graysay
*Assistant Examiner*—Frederick L. Lagman
*Attorney, Agent, or Firm*—Marshall, O'Toole, Gerstein, Murray & Borun

[57] ABSTRACT

A cable truss support system for supporting the roof of a mine includes two cables each having an end secured in the roof of a mine. The other ends of the cables are connected by a twisted ring anchor and are secured to the anchor by wedges through which the cables pass.

8 Claims, 3 Drawing Sheets

TENSIONABLE CABLE TRUSS SUPPORT SYSTEM

TECHNICAL FIELD OF THE INVENTION

The present invention relates generally to mine roof support systems, and more particularly to a system for connecting multiple cables to support the roof of a mine.

BACKGROUND OF THE INVENTION

There are numerous methods for supporting the roof of an under-ground mine. One such method is the cross-bar method wherein beams fabricated of wood, steel, or another material are placed against a mine roof. Each end of each beam is supported by a post made from any of the materials used in making the beams or, alternatively, from concrete. The crossbar method has the disadvantage that the posts can be accidentally knocked out by moving machinery, thus endangering the miners. To protect miners in such situations, cable or steel straps are bolted into the roof in order to support the beam should a post be knocked out. The beams can also be drilled and bolted directly to the roof. Installing crossbars is a slow and labor-intensive process, the materials are expensive, and installation can be hazardous. Moreover, wood is not a permanent material even if it is treated.

In another method, continuous bolt trusses are fabricated from angled roof bolts anchored into the roof by mechanical devices or adhesive resins. The bolts are connected by means of one or more tie-rods and a turnbuckle. Tightening of the turnbuckle can produce compressive forces in the roof rock which increases the strength of the rock. However, because the turnbuckle length or take-up is limited, the roof bolt holes must be precisely located or, otherwise, various lengths of tie-rods must be available to be connected to the roof bolts and turnbuckle in order to allow the truss system to be tensioned. Further, the threads cut or rolled into the ends of the roof bolts and tie-rods act as stress concentration points and also reduce the effective area of the bolt/tie-rod, thus reducing the effective ultimate strength of the system. Fine machine threads are subject to damage, rust, and corrosion. Still further, assembly of the continuous bolt multi-segment tie-rod truss system is time-consuming.

In a third method, multiple angled bolt trusses are fabricated by securing an end of each of two bolts at angles in the roof of the mine and by passing the other ends of the two bolts through plates or brackets such that each bolt is tensioned separately. Tie-rods, in two to five sections, are connected to the plates or brackets using turnbuckles or tensioning bolts and couplers such that the turnbuckles or tensioning bolts can tension the tie-rods. Since the tie-rods and bolts are tensioned separately, the compressive forces on the roof rock may be unequal. This may result in one bolt being overloaded close to failure while the tie-rod and opposite bolt have little or no stress. The roof bolt holes must be located at precise distances to allow tensioning within the limited range of a turnbuckle or tensioning bolt or else several sections of various lengths of tie-rods must be available to achieve the proper tie-rod length. This method suffers from the same drawbacks as the previous method described above.

In a fourth method, cable slings of lengths of wire rope are used to support the mine roof. The wire rope is attached to a split tube and the latter is driven up into a grout-filled bore hole by a split tube driver. However, variations in bore hole diameter due to drilling and/or rock movement hinder the passage of the split tube such that there is little control of the tension on the wire rope. After installation, some cables have no tension and must be blocked with wood to the roof and tightened with wedges. Also, the impact driving of the split tubes is slow and very noisy, and requires three operators to install a cable sling. Furthermore, impact driving of the split tubes can disturb the roof and ribs and may dislodge material thus endangering miners.

SUMMARY OF THE INVENTION

These disadvantages can be eliminated and/or minimized by the present invention. In a first embodiment of the invention, a tensionable cable truss system for supporting a roof of a mine includes a first and a second cable extending generally along the roof of a mine, a means for securing the first cable to a first bore in the roof of the mine and a means for securing the second cable to a second bore in the roof of the mine, a twisted ring anchor for connecting the first and second cables together so as to support the roof of the mine, and a means for securing the first and second cables to the twisted ring anchor.

The twisted ring anchor has a first and a second bore. The first cable extends through the first bore in the twisted ring anchor and the second cable extends through the second bore in the twisted ring anchor. The centerlines of the bores are curved and tilted with respect to one another. The curved shape of the bores and the tilt of the centerline planes allow the first and second cables to bend to distribute the tension in the cables. The first cable extends into the first bore through a first end and exits through a second end and the second cable extends into the second bore through a first end and exits through a second end.

The securing means comprises a first three-part wedge positioned inside the second end of the first bore such that the first three part wedge exerts frictional force on the twisted ring anchor and the first cable to secure the first cable to the twisted ring anchor. The securing means further comprises a second three-part wedge positioned inside the second end of the second bore such that the second three-part wedge exerts frictional force on the twisted ring anchor and the second cable to secure the second cable to the twisted ring anchor.

In another embodiment of the present invention, a tensionable cable truss system for supporting the roof of a mine comprises a first, second, and third cable extending generally along the roof of a mine, a means for securing the first cable to a first bore in the roof of the mine and a means for securing the second cable to a second bore in the roof of the mine, a first twisted ring anchor for connecting a first end of the third cable to the first cable and a second twisted ring anchor for connecting a second end of the third cable to the second cable. The cable truss system also includes a first means for securing the first and third cable to the first twisted ring anchor and a second means for securing the second and third cables to the second twisted ring anchor. The twisted ring anchors and securing means are similar to the twisted ring anchor and the securing means of the first embodiment.

In the present invention, there is no need to maintain a supply of different length rods. A single roll of cable may be maintained and cut to size when needed. The flexibility of the cable makes it easier to bend the cable to extend into the bores in the mine roof and into the bores in the twisted ring anchor. The use of cables rather than rigid steel rods also allows the present system to be used in low clearance areas where the installation of rigid rods is difficult due to the limited space. In addition, the use of cable eliminates the need for bulky machinery needed to bend the steel rods used in other support systems. The curved bores of the twisted ring anchor allow the cables to bend in a bending arc, reducing localized stress on the cables and allowing the cable truss system to support more weight. The roof truss system according to the present invention has few parts and may be installed with smaller handheld tools in areas with minimal clearance, such as alongside conveyors and piping, which is important because installation of a mine roof support system must follow as soon as possible after the extraction of material in order to maintain roof rock strength and avoid roof falls.

BRIEF DESCRIPTION OF THE DRAWINGS

These and other features and advantages will become more apparent from a detailed consideration of the invention when taken in conjunction with the drawings in which.

DESCRIPTION OF THE PREFERRED EMBODIMENT

Figure 1:
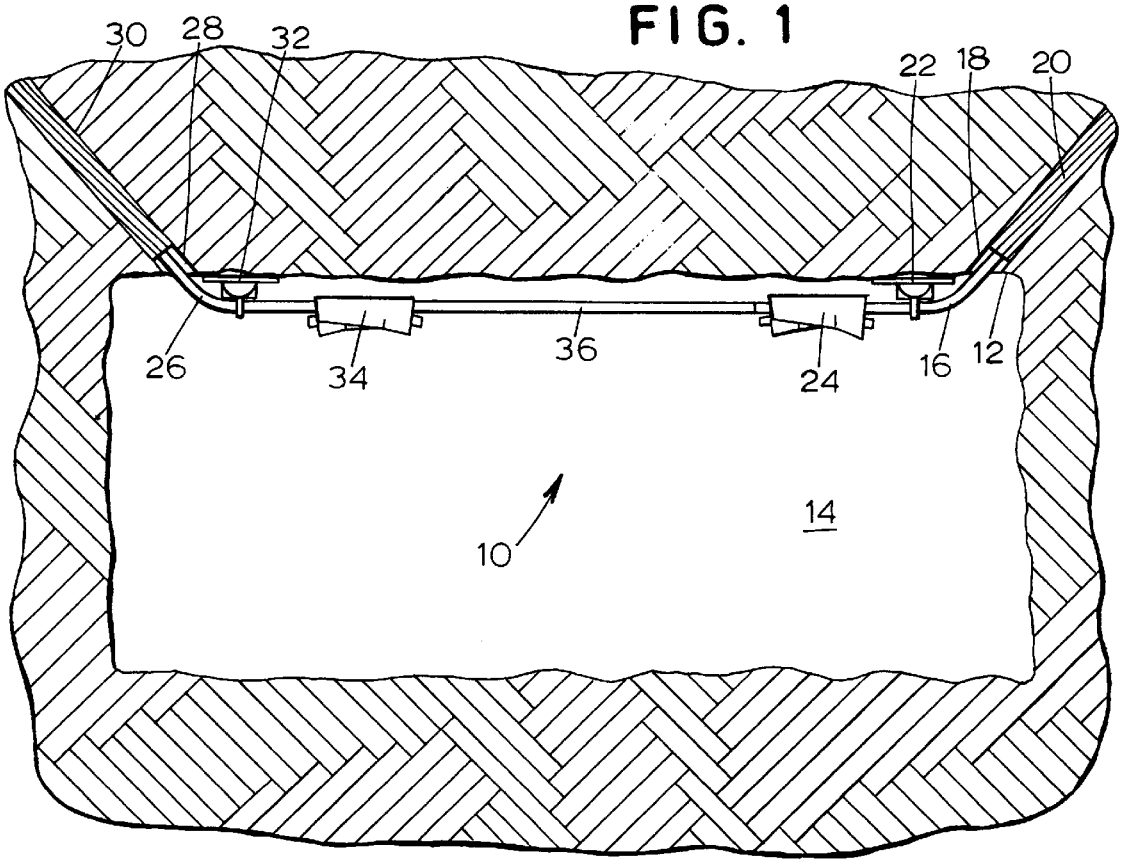
FIG. 1 is an elevational view partly in section of the tensionable cable truss support system according to the present invention.
Figure 2:
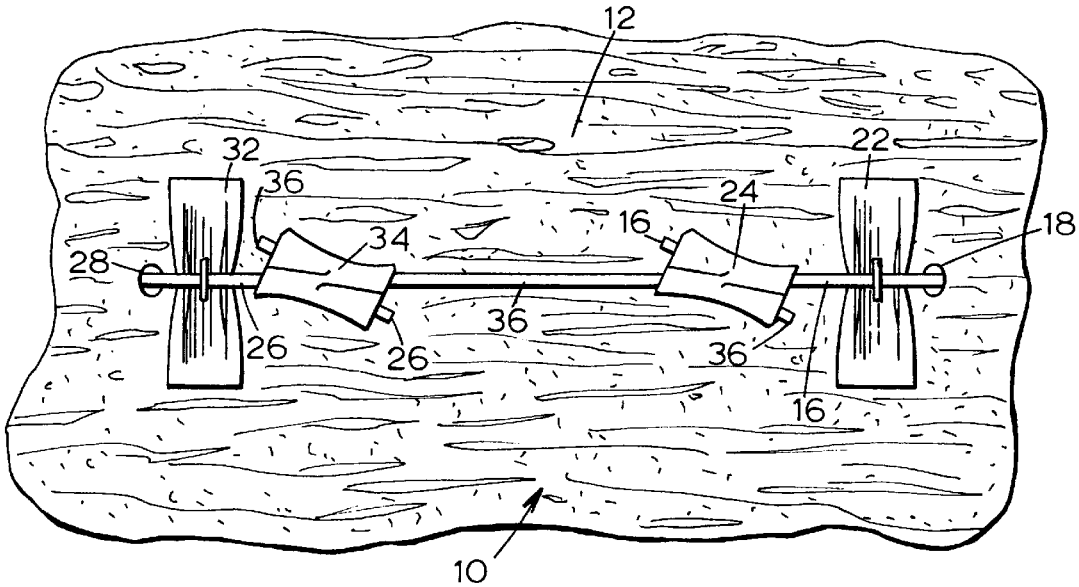
FIG. 2 is a view from below of the system of FIG. 1.

Referring to FIGS. 1 and 2, a cable truss system 10 is used to support a roof 12 of a mine passage 14. A typical mine would incorporate a plurality of such cable truss systems 10 spaced along the mine passage 14. The cable truss system 10 includes a first cable 16 retained in a first bore 18 in the roof 12 of the mine passage 14 by any suitable means, such as a resin cartridge 20. The first bore 18 is slanted at an angle outward from the mine passage 14. The first cable 16 passes through a ring eye plate 22 and extends through a first bore 38 (shown in FIG. 4) in a first twisted ring anchor 24. The ring eye plate 22 is pressed against the roof of the mine passage 14 by the first cable 16. A second cable 26 is retained in a second bore 28 in the mine roof 12, again by any suitable means such as a second resin cartridge 30. The second bore 28 is also slanted at an angle outward from the mine passage 14 away from the first bore 18. The second cable 26 passes through a second ring eye plate 32 and extends through a first bore in a second twisted ring anchor 34, which is identical to the first twisted ring anchor 24. A third cable 36 has a first end extending through a second bore 46 (shown in FIG. 4) in the first twisted ring anchor 24 and a second end extending through a second bore in the second twisted ring anchor 34. The ends of the cables 16, 26, and 36 are secured in the fashion noted hereinafter to the twisted ring anchors 24, 34 and the third cable 36 is tensioned so as to pull the twisted ring anchors 24, 34 toward one another. This causes the first and second cables 16, 26 to be under tension as well. The first and second cables 16, 26 press against the ring eye plates 22, 32, creating a compressive force that helps support the roof 12.

Figure 3:
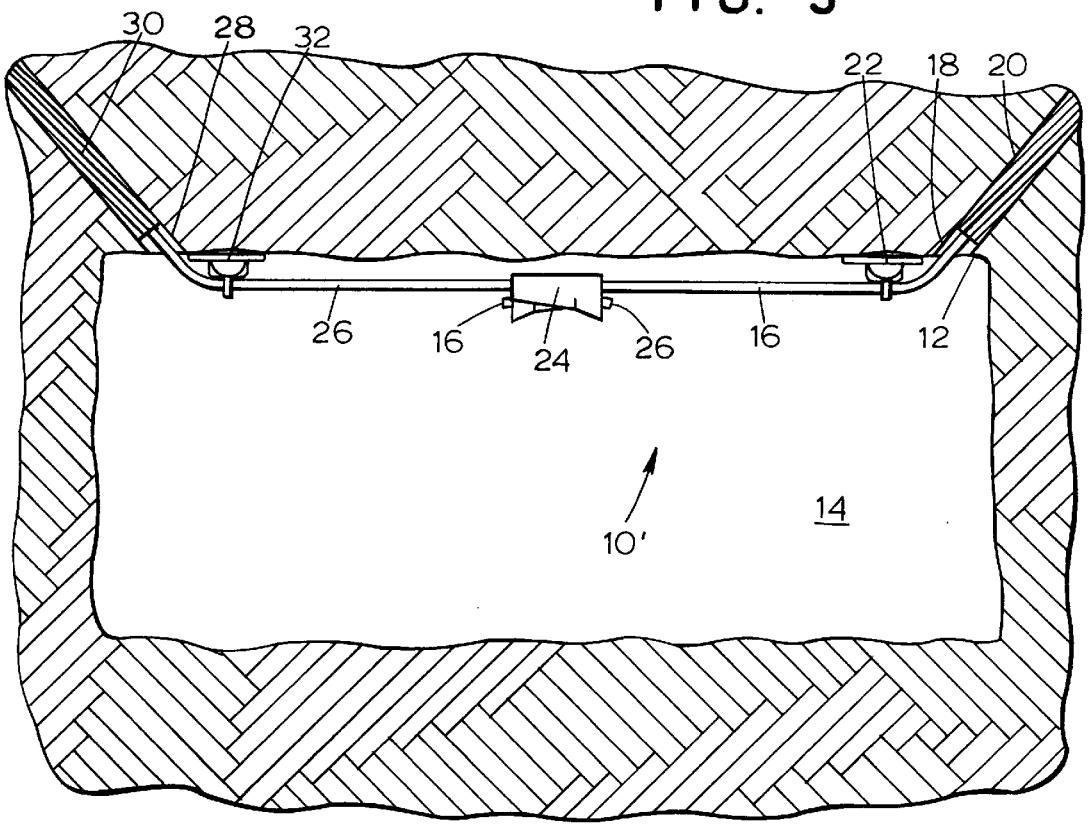
FIG. 3 is a view similar to FIG. 1 of a second embodiment of the present invention.

FIG. 3 illustrates a cable truss system 10' according to an alternative embodiment of the present invention. In this embodiment, the third cable 36 and the second twisted ring anchor 34 are not utilized. Instead, the lengths of the first cable 16 and/or the second cable 26 are increased such that the cables 16, 26 can be connected to one another by the first twisted ring anchor 24. When the cables 16, 26 are connected to the ring anchor 24, they are placed under tension such that a compressive force is generated to support the roof 12.

Figure 4:
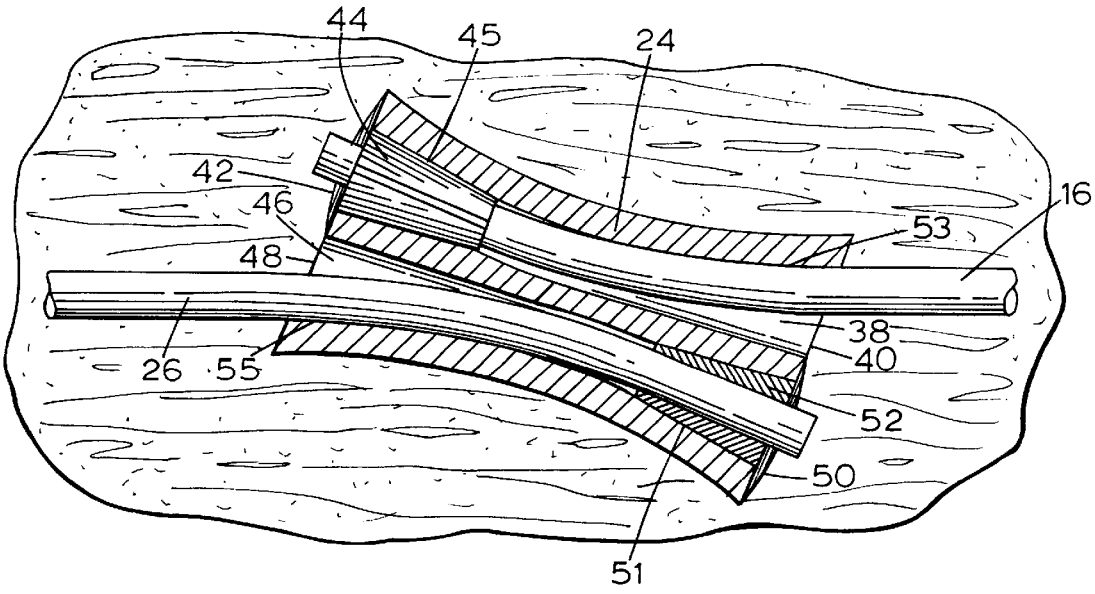
FIG. 4 is a partial sectional view of the twisted ring anchor of FIG. 1 or FIG. 3 with two cables inserted and fastened by three-part wedges.

FIG. 4 illustrates the twisted ring anchor 24 of FIG. 3 in greater detail. The first cable 16 enters the first bore 38 in the twisted ring anchor 24 through a first end 40. The first cable 16 is secured at a second end 42 of the first bore 38 by a first three-part tapered wedge 44. Other securing means, such as a two-part wedge, may alternatively be used to secure the first cable 16 to the twisted ring anchor 24. The second end 42 of the first bore 38 includes a substantially conical wedge seat 45 that is also tapered such that the diameter of the bore 38 decreases as the bore 38 extends inwardly from the second end 42. The three-part wedge 44 is assembled around the first cable 16 and is inserted into the first bore 38. During tensioning, the wedge 44 is pulled into engagement with the wedge seat 45 of the first bore 38, whereupon the wedge 44 exerts an increasing frictional force on the first cable 16 to grip the first cable 16 and prevent the first cable 16 from slipping through the wedge 44.

The second cable 26 enters the second bore 46 in the twisted ring anchor 24 through a first end 48. The second end 50 of the second bore 46 includes a conical wedge seat 51 that is also tapered like the first bore 38 to allow the second wedge 52 to hold the second cable 26 in place through frictional force. The three-part wedges 44, 52 are tapped into place in the wedge seats 45, 51 with a hammer, and the free end of the second cable 26 is fed through a hollow cylinder ram (not shown). The ram is used to place the second cable 26, and therefore the entire cable truss system, under tension. The tension in the cables 16, 26 created by the hollow cylinder ram pulls the first three-part wedge 44 into the twisted ring anchor 24. A protrusion on the cylinder ram presses against the second three-part wedge 52 and prevents the wedge 52 from being pulled out of the twisted ring anchor 24 as the cable 26 is being tensioned.

As shown in FIG. 4, when the first cable 16 and the second cable 26 are under tension the cables 16, 26 rotate the twisted ring anchor 24 until the first cable 16 and the second cable 26 align themselves in a straight line. Each of the first and second bores 38, 46 has a curved internal surface 53, 55 that allow the cables 16, 26 to bend when under tension. This bend distributes the forces developed in the cables over longer cable lengths. Without the curve in the bores 38, 46, the first and second cables 16, 26 would form kinks or be abraded or cut by the sharp edges that are found in prior art devices.

Referring to FIGS. 5–8, it can be seen that the centerlines of the first bore 38 and the second bore 46 are inclined in opposite directions so that the centerlines cross. In addition, the walls of each bore 38, 46 are curved at areas 53, 55. This gives the cables 16 and 26 a bend in a second dimension that further distributes the tension throughout the cables 16 and 26.

Figure 5:
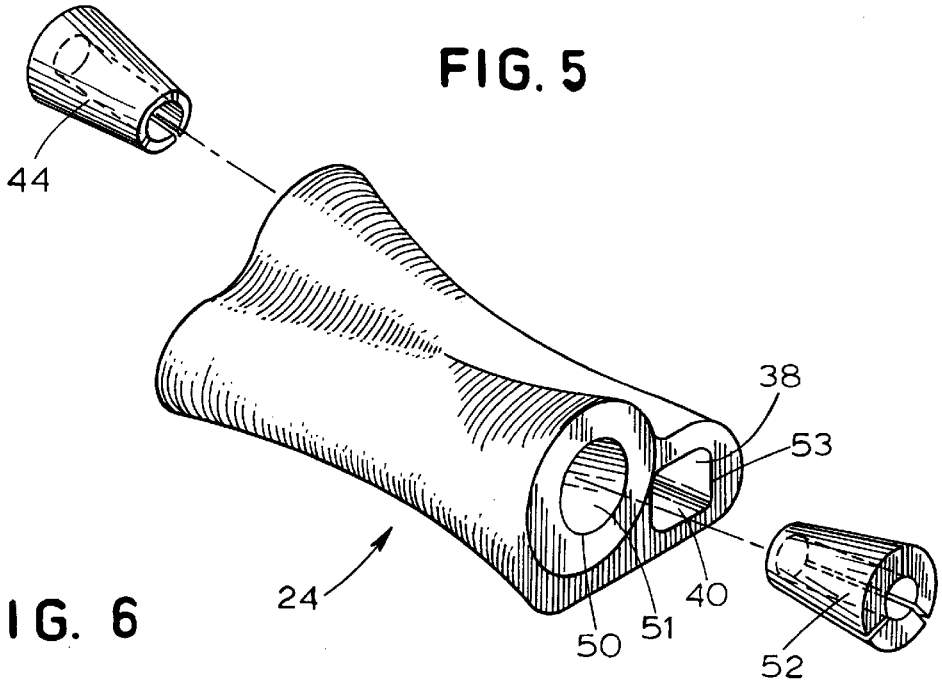
FIG. 5 is an exploded isometric view of the twisted ring anchor together with the three-part wedges.
Figure 6:
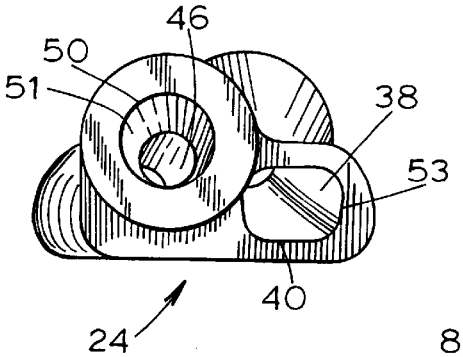
FIG. 6 is an end elevational view of the twisted ring anchor.
Figure 7:
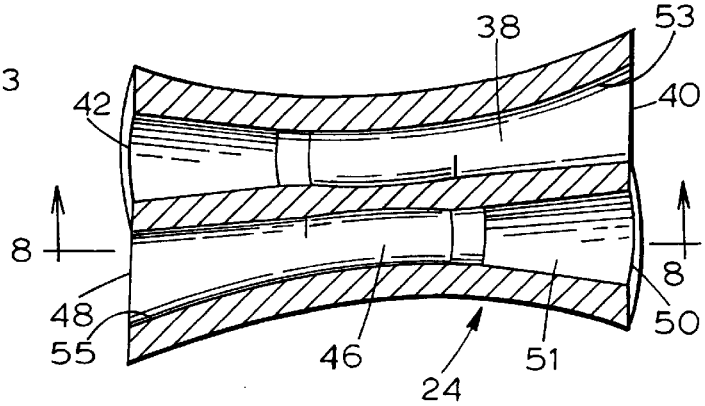
FIG. 7 is a sectional view taken at the centerlines of the holes in the twisted ring anchor.
Figure 8:
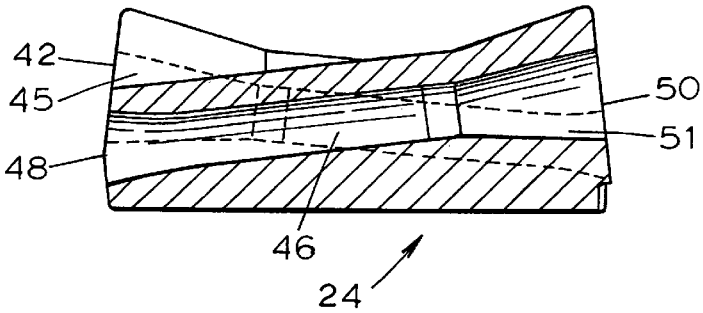
FIG. 8 is a sectional view taken generally along the line 8—8 of FIG. 7.

FIG. 5 also shows the three-part wedge 52 in more detail. The outside diameter of the wedge 52 is gradually reduced from the outer end to the inner end of the wedge 52. The inner diameter of the wedge 52 is constant throughout the length of the wedge 52. This allows the wedge 52 to grip the second cable 26 evenly. The wedge 52 is divided into three sections of approximately 120 degrees each. A small gap exists between the three wedge sections. As the wedge 52 is pulled inside of the second end 50 of the second bore 46, the wedge sections are forced toward one another by the walls of the wedge seat 51. This reduces the gaps between the wedge sections until the wedge sections press against the second cable 26.

Many embodiments, modifications and variations have been shown herein and many more are possible in light of the above teachings. It is therefore intended that the foregoing detailed description be regarded as illustrative rather than limiting and that it be understood that it is the following claims, including all equivalents, that are intended to define the scope of this invention.

What is claimed is:

1. A tensionable cable truss support system for supporting a roof of a mine, the roof having first and second bores therein, the roof support system comprising:

a) a first cable extending generally along the roof of the mine;

b) means for securing the first cable to the first bore;

c) a second cable extending generally along the roof of the mine;

d) means for securing the second cable to the second bore;

e) a twisted ring anchor for connecting the first and second cables together so as to support the roof of the mine, said twisted ring anchor having a first bore and a second bore, wherein the centerlines of said bores are curved and wherein the centerlines of the bores are tilted with respect to one another, and wherein the first cable extends through the twisted ring anchor through the first bore and the second cable extends through the twisted ring anchor through the second bore and wherein the curved shape of the bores and the tilt of the centerline planes allow the first and second cables to bend in order to distribute the tension in the cable; and f) means for securing the first and second cables to the twisted ring anchor.

2. The tensionable cable truss support system of claim 1 wherein a) the first cable extends into the first bore through a first end and exits the first bore through a second end;

b) the second cable extends into the second bore through a first end and exits the second bore through a second end;

c) the securing means comprises a first three-part wedge positioned inside the second end of the first bore such that the first three part wedge exerts frictional force on the twisted ring anchor and the first cable to secure the first cable to the twisted ring anchor;

d) the securing means further comprises a second three-part wedge positioned inside the second end of the second bore such that the second three-part wedge exerts frictional force on the twisted ring anchor and the second cable to secure the second cable to the twisted ring anchor; and e) the twisted ring anchor and the first and second three-part wedges hold the first and second cables together in roof supporting fashion.

3. The tensionable cable truss support system of claim 2, wherein a) the first bore is beveled to form a frustum-shaped wedge seat extending from the second end of the first bore inward, such that the diameter of the first bore decreases for a distance as the first bore extends from the second end of the first bore toward the first end; and b) the second bore is beveled to form a frustum-shaped wedge seat extending from the second end of the second bore inward, such that the diameter of the second bore decreases for a distance as the second bore extends from the second end of the second bore toward the first end.

4. The tensionable cable truss support system of claim 1, further comprising a) a first ring-eye plate for securing the first cable to the roof of the mine, wherein the first ring-eye plate is secured to the roof of the mine and the first cable passes through an opening on the first ring-eye plate; and b) a second ring-eye plate for securing the second cable to the roof of the mine, wherein the second ring-eye plate is secured to the roof of the mine and the second cable passes through an opening on the second ring-eye plate.

5. A tensionable cable truss support system for supporting a roof of a mine, the roof having first and second bores therein, the roof support system comprising:

a) a first cable extending generally along the roof of the mine;

b) means for securing the first cable to the first bore;

c) a second cable extending generally along the roof of the mine;

d) means for securing the second cable to the second bore;

e) a third cable extending generally along the roof of the mine;

f) a first twisted ring anchor for connecting a first end of the third cable to the first cable, said first twisted ring anchor having a first and a second bore, wherein the centerlines of the first and the second bores are curved, and wherein the centerlines of the bores are tilted with respect to one another and wherein the curve of the bores and the tilt of the centerline planes allow the first and third cables to bend in order to distribute the tension in the cables;

g) first means for securing the first and third cables to the first twisted ring anchor;

h) a second twisted ring anchor for connecting a second end of the third cable to the second cable, said second twisted ring anchor having a first and a second bore, wherein the centerlines of the first and the second bores are curved, and wherein the centerlines of the bores are tilted with respect to one another and wherein the curve of the bores and the tilt of the centerline planes allow the second and third cables to bend in order to distribute the tension more evenly throughout the cables in the twisted ring anchor; and i) second means for securing the second and third cables to the second twisted ring anchor.

6. The tensionable cable truss support system of claim 5 wherein a) the first cable enters through a first end of the first bore in the first twisted ring anchor and exits through a second end of the first bore in the first twisted ring anchor;

b) the first end of the third cable enters through a first end of the second bore in the first twisted ring anchor and exits through a second end of the first bore in the first twisted ring anchor;

c) the second cable enters through a first end of the first bore in the second twisted ring anchor and exits through a second end of the first bore in the second twisted ring anchor;

d) the second end of the third cable enters through a first end of the second bore in the second twisted ring anchor and exits through a second end in the second bore of the second twisted ring anchor;

e) the first securing means comprises a first three-part wedge positioned inside the second end of the first bore in the first twisted ring anchor such that the first three-part wedge exerts frictional force on the first twisted ring anchor and the first cable to secure the first cable to the first twisted ring anchor;

f) the first securing means further comprises a second three-part wedge positioned inside the second end of the second bore in the first twisted ring anchor such that the second three-part wedge exerts frictional force on the first twisted ring anchor and the first end of the third cable and secures the first end of the third cable to the first twisted ring anchor;

g) the second securing means comprises a third three-part wedge positioned inside the second end of the first bore of the second twisted ring anchor such that the third three-part wedge exerts frictional force on the second twisted ring anchor and the second end of the third cable to secure the second end of the third cable to the second twisted ring anchor;

h) the second securing means further comprises a fourth three-part wedge positioned inside the second end of the second bore of the second twisted ring anchor such that the fourth three-part wedge exerts frictional force on the second twisted ring anchor and the second cable and secures the second cable to the second twisted ring anchor;

i) the first twisted ring anchor and the first and second three-part wedges hold the first and third cables together in roof supporting fashion; and j) the second twisted ring anchor and the third and fourth three-part wedges hold the second and third cables together in roof supporting fashion.

7. The tensionable cable truss support system of claim 6, wherein a) the first bore of each twisted ring anchor is beveled to form a frustum-shaped wedge seat extending from the second end of the first bore inward, such that the diameter of the first bore decreases for a distance as the first bore extends from the second end inward; and b) the second bore of each twisted ring anchor is beveled to form a frustum-shaped wedge seat extending from the second end of the second bore inward, such that the diameter of the second bore decreases for a distance as the second bore extends from the second end inward.

8. The tensionable cable truss support system of claim 7, further comprising a) a first ring-eye plate for securing the first cable to the roof of the mine, wherein the first ring-eye plate is secured to the roof of the mine and the first cable passes through an opening on the first ring-eye plate; and b) a second ring-eye plate the roof of the mine, wherein the second ring-eye plate is secured to the roof of the mine and the second cable passes through an opening on the second ring-eye plate.

* * * * *